US008784649B2

(12) United States Patent
Weisselberg

(10) Patent No.: US 8,784,649 B2
(45) Date of Patent: Jul. 22, 2014

(54) METHOD FOR THE PYROLYTIC EXTRACTION OF HYDROCARBON FROM OIL SHALE

(71) Applicant: Wyssmont Company Inc., Fort Lee, NJ (US)

(72) Inventor: Edward Weisselberg, Kinnelon, NJ (US)

(73) Assignee: Wyssmont Company Inc., Fort Lee, NJ (US)

( * ) Notice: Subject to any disclaimer, the term of this patent is extended or adjusted under 35 U.S.C. 154(b) by 0 days.

(21) Appl. No.: 13/678,059

(22) Filed: Nov. 15, 2012

(65) Prior Publication Data

US 2013/0146507 A1 Jun. 13, 2013

Related U.S. Application Data

(62) Division of application No. 12/589,394, filed on Oct. 22, 2009, now Pat. No. 8,435,404.

(51) Int. Cl.
*C10G 1/04* (2006.01)

(52) U.S. Cl.
USPC ..... 208/400; 208/390; 208/407; 208/408; 34/64; 34/65; 34/218; 34/219; 34/226; 34/505; 202/109; 202/117; 202/118

(58) Field of Classification Search
USPC ..... 208/390, 400, 407–408; 34/64–65, 34/218–219, 226, 505; 202/109, 117–118
See application file for complete search history.

(56) References Cited

U.S. PATENT DOCUMENTS

| | | | | |
|---|---|---|---|---|
| 3,777,409 | A | 12/1973 | Weisselberg et al. | |
| 4,404,086 | A | 9/1983 | Oltrogge | |
| 4,487,257 | A | 12/1984 | Dauphine | |
| 4,534,849 | A | 8/1985 | Edwards | |
| 4,692,238 | A | 9/1987 | Bodle et al. | |
| 4,786,368 | A | 11/1988 | York et al. | |
| 7,229,547 | B2 * | 6/2007 | Merrell et al. | 208/81 |
| 2007/0181465 | A1 | 8/2007 | Collette | |
| 2009/0100701 | A1 | 4/2009 | Ulrich | |

OTHER PUBLICATIONS

Al-Ayed et al., Oil Shale, 26(2); 139-147 (2009).
Alderson, Oil Shale, Synthetic Fuels Data Handbook, Cameron Engineers, Inc., (1978).
DOE Office of Petroleum Reserves—Strategic Unconventional Fuels, Fact Sheet: Oil Shale Conversation Technology, 2000.
ECCOS, www.eccos.us/Default.aspx?tabid=843, Oil Shale Technologies, Jul. 2009.
Federal Register: Dec. 24, 2008 (vol. 73, No. 248)] [Notices] [p. 79089-79096].
German Low-Temperature Coal-Tar Industry, Feb. 1949.
International Search Report PCT/US2010/036524, dated Jul. 26, 2010.

(Continued)

*Primary Examiner* — Brian McCaig
(74) *Attorney, Agent, or Firm* — Lerner, David, Littenberg, Krumholz & Mentlik, LLP

(57) ABSTRACT

A method for the pyrolytic extraction of hydrocarbons such as shale oil from kerogen. Oil shale containing kerogen which has been ground into particulate form, is cascaded downwardly between a plurality of rotating trays within a heated processing chamber. As the hydrocarbons are volatized within the chamber, the volatiles are collected and condensed within a condenser or other suitable recovery apparatus.

12 Claims, 3 Drawing Sheets

(56) References Cited

OTHER PUBLICATIONS

Kerogen, Wikipedia, Jun. 2009.
Laherrere, Review on Oil Shale Data, Sep. 2005.
Oil Shale, Wikipedia, Jun. 2009.
Oil Shales, Working Document of the NPC Global Oil & Gas Study, Topic Paper # 27, Jul. 2007.
Overview of Low Temperature Carbonisation, May 2004.
Schmidt, Technology Selection for an Oil Shale Deposit, International Conference on Oils Shale, Amman, Jordan, Nov. 2006.
Shale Oil Extraction, Wikipedia, Jul. 2009.
Stuart Oil Shale Project, Wikipedia, Jul. 2009.
www.ostseis.anl.gov/guide/oilshale/index.cfm, About Oil Shale, Jun. 2009.
www.science.howstuffworks.com/oil-refining2.htm, From Crude Oil, Jun. 2009.
www.science.howstuffworks.com/oil-refining3.htm, Jun. 2009.

* cited by examiner

METHOD FOR THE PYROLYTIC EXTRACTION OF HYDROCARBON FROM OIL SHALE

CROSS REFERENCE TO RELATED APPLICATIONS

The present application is a divisional of U.S. patent application Ser. No. 12/589,394 filed Oct. 22, 2009, now U.S. Pat. No. 8,435,404 the disclosure of which is incorporated herein by reference.

BACKGROUND OF THE INVENTION

The present invention relates in general to the extraction of hydrocarbons from oil shale containing kerogen, and more particularly, to a method for pyrolytic extraction of shale oil from oil shale.

Oil shale is a fine grain sedimentary rock containing: (1) Organic matter derived chiefly from aquatic organisms or waxy spores or pollen grains, which is only slightly soluble in ordinary petroleum solvents, and of which a large proportion is distillable into synthetic petroleum, and (2) inorganic matter, which may contain other minerals. This term is applicable to any argillaceous, carbonate, or siliceous sedimentary rock which, through destructive distillation, will yield synthetic petroleum.

The hydrocarbon in oil shale is known as kerogen. Kerogen is a pyrobitumen, and oil is formed from kerogen by heating. It consists chiefly of low forms of plant life; chemically it is a complex mixture of large organic molecules, containing hydrogen, carbon, oxygen, nitrogen, and sulfur. Kerogen is the chief source of oil in oil shale.

The shale oil extraction process decomposes oil shale and converts kerogen in oil shale into petroleum-like synthetic crude oil. The process can be conducted by pyrolysis, hydrogenation, or thermal dissolution. The common extraction process (also known as retorting) is pyrolysis. In the pyrolysis process, oil shale is heated until its kerogen decomposes into vapors of a condensable shale oil and non-condensable combustible oil shale gas (shale gas can also refer to the gases that occur naturally in shales). In addition, oil shale processing produces spent shale, a solid residue. Depending on the technology, spent shale may include char, a carbonaceous residue formed from kerogen. Oil vapors and oil shale gas are separated from the spent oil shale and cooled, causing the shale oil to condense.

The temperature when perceptible decomposition of oil shale occurs depends on the time-scale of the process. In the above ground retorting process the perceptible decomposition occurs at about 300° C. (570° F.), but proceeds more rapidly and completely at higher temperatures. The rate of decomposition is the highest at a temperature of about 480° C. (900° F.) to about 520° C. (970° F.). The ratio of oil shale gas to shale oil depends on retorting temperature and as a rule increases by the rise of temperature. For the modern in-situ process, which might take several months of heating, decomposition may be conducted as low as 250° C. (480° F.).

Pyrolysis, being endothermic, requires an external source of energy. Most technologies use combustion of different fuels such as natural gas, oil, shale oil or coal, to generate heat, although some experimental extraction methods use electricity, radio frequency, microwaves, or reactive fluids for this purpose. Oil shale gas and char produced in the retorting process as by-products may be burned as an additional source of energy, and the heat of the spent oil shale and oil shale ash may be reused to pre-heat the raw oil shale. In addition to shale oil, other useful products could be generated during the process, including ammonia, sulfur, aromatic compounds, pitch, asphalt, and waxes.

The present invention provides a method heretofore unknown for the extraction of shale oil by pyrolytic decomposition of the oil shale into its hydrocarbon fractions.

SUMMARY OF THE INVENTION

The present invention further describes a method for extracting shale oil from oil shale containing kerogen, the method comprising cascading oil shale in particulate form between a plurality of trays vertically stacked within at least one heated processing zone provided within a material processing chamber, heating the oil shale within at least one heated processing zone to volatize the shale oil from the kerogen, condensing the volatized shale oil, and discharging the residual of the oil shale from the material processing chamber.

The present invention further describes a method for extracting shale oil from oil shale containing kerogen, the method comprising passing oil shale in particulate form downwardly between a plurality of horizontal rotating material supports within a material processing chamber, heating the oil shale within the material processing chamber to a sufficient temperature to volatize the shale oil from the kerogen, discharging the volatized shale oil from the material processing chamber, condensing the volatized shale oil, and discharging the residual oil shale from the material processing chamber.

The present invention further includes a method for extracting hydrocarbons from oil shale containing kerogen, the method comprising supplying oil shale in particulate form to a material processing chamber having an upper processing zone and a lower processing zone, the material processing chamber including a plurality of vertically displaced material supports extending through the upper processing zone and the lower processing zone, passing the oil shale downwardly within the material processing chamber from one material support to another underlying material support, applying heat within the upper and lower processing zones within the material processing chamber for volatizing the hydrocarbons from the kerogen, discharging a first volatized oil shale component from said upper processing zone within the material processing chamber, discharging a second volatized oil shale component from said lower processing zone within the material processing chamber, condensing at least one of the volatized oil shale components, and discharging the residual oil shale from the material processing chamber.

The present invention further includes a method for extracting hydrocarbons from kerogen containing oil shale, the method comprising supplying kerogen containing oil shale in particulate form to a material processing chamber having an upper processing zone and a lower processing zone, the material processing chamber including a plurality of vertically displaced material supports extending between the upper processing zone and the lower processing zone, passing the oil shale downwardly within the material processing chamber from one material support to another underlying material support, applying heat within the upper and lower processing zones within the material processing chamber for volatizing the hydrocarbons within the kerogen, discharging a first volatized shale oil component from said upper processing zone within the material processing chamber, discharging a second volatized shale oil component from said lower processing zone within the material processing chamber, condensing at least one of the volatized shale oil components, and discharging the residual oil shale from the material processing chamber.

The present invention further includes a method for extracting shale oil from oil shale, the method comprising transferring oil shale through a heated processing chamber between a plurality of material supports arranged in a vertical stack within the processing chamber, heating the oil shale within the plurality of material supports, the heating of the oil shale volatizing shale oil contained in the oil shale, and condensing the volatized shale oil.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof may best be understood by reference to the following detailed description when read with the accompanying drawings.

DETAILED DESCRIPTION

Figure 1:
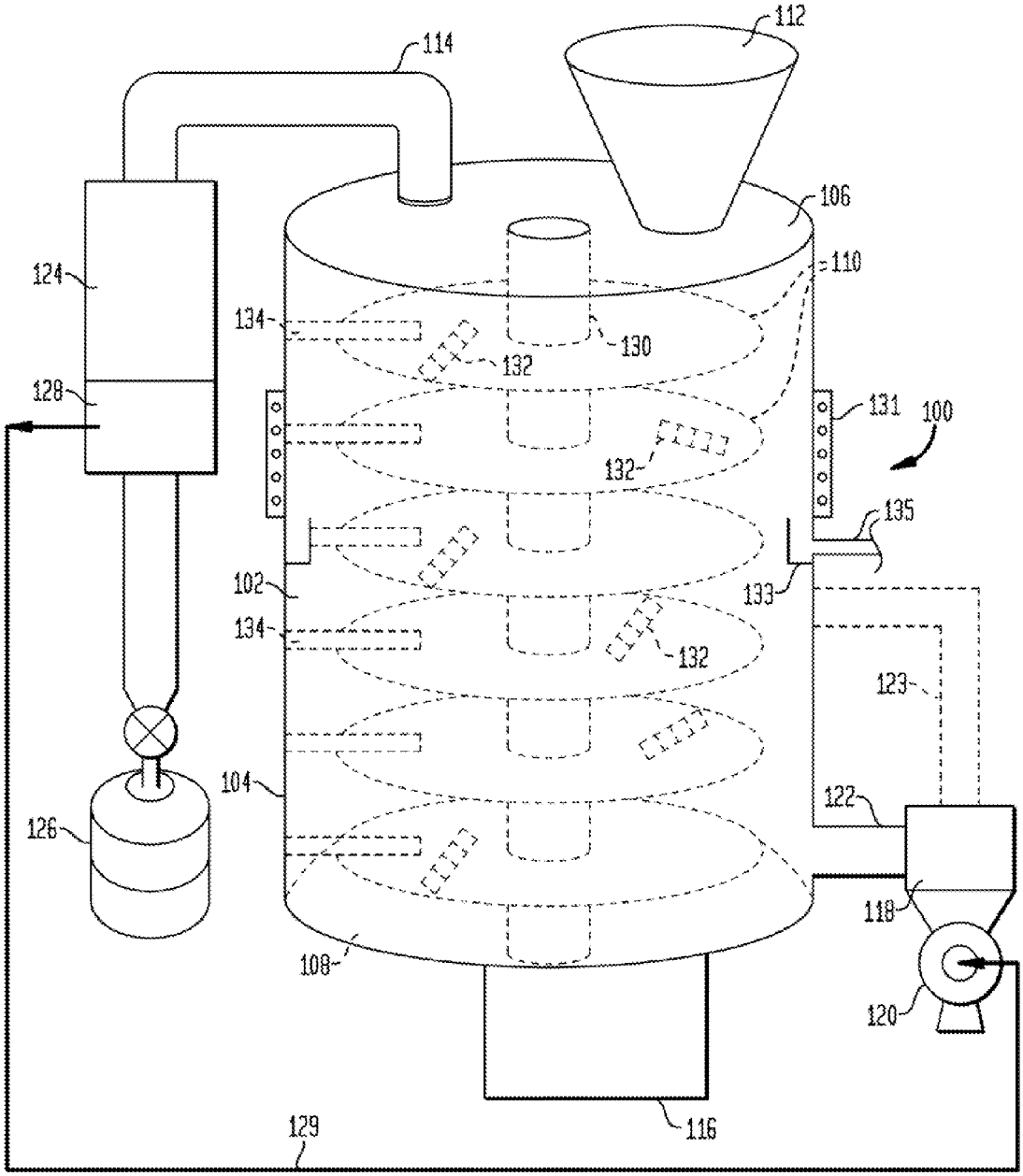
FIG. 1 is a diagrammatic front perspective view of an apparatus for extracting hydrocarbons from oil shale such as shale oil in accordance with one embodiment of the present invention.

In describing the preferred embodiments of the invention illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose.

FIG. 1 shows an example of an apparatus 100 for the pyrolytic extraction of hydrocarbons from oil shale such as shale oil in accordance with one embodiment of the present invention. As shown, a hollow chamber 102 forming the oil shale processing chamber is cylindrically or polygonally enclosed by sidewall 104 which extends around the circumference of the chamber, a top plate 106, and a bottom plate 108. The chamber has a plurality of internal processing zones which are contiguous with each other thereby forming essentially a single continuous processing chamber where extracting shale oil from the kerogen contained within the oil shale and other condensable and non-condensable hydrocarbons takes place simultaneously or serially at a plurality of levels or zones within the chamber at substantially atmospheric conditions. The chamber 102 is preferably maintained at a pressure of about ±0.05 to ±0.10 inches water, although higher or lower pressures are contemplated.

According to this aspect of the invention, pyrolytic extraction of the various hydrocarbon components of the kerogen in the oil shale is generally performed at various levels within the chamber 102, depending on the volatility of the hydrocarbons and the temperature at each level. In this manner, the apparatus can operate continuously by continuously supplying material to be processed through a feed port 112 such as in the top plate 106 and removing continuously the volatized hydrocarbons from a vapor outlet 114 such as also in the top plate. The spent residual oil shale, referred to as spent shale, may be removed from the apparatus 100 through a residual discharge port 116 such as in the bottom plate 108. The various processing zones may operate at substantially atmospheric pressure and substantially the same temperature, or one zone may operate at a higher or lower temperature relative to other zones.

The processing zones within the chamber 102 may be heated using heated inert gas such as nitrogen from heater 118 and intake fan 120 supplied through hot gas inlet 122. The heated gas may also be supplied to multiple levels of the different processing zones within the chamber 102 as shown by heated gas inlets 122, 123 from a single heater 118. Accordingly, the supplied heated gas may be at the same or different temperatures for one or more of the processing zones. Although heated nitrogen is the preferred heating medium, other inert gases may be used. In addition, electric or gas fire heaters may be used to heat gases as may be desired The volatized hydrocarbons from the vapor outlet 114 are passed to a conventional condenser 124, such as shell and tube, for recovery of the shale oil and other volatiles extracted from the kerogen in the oil shale. The recovered shale oil 126 can be further processed at a refinery for recovery of the various hydrocarbon fractions. Any non-condensable vapors can be passed through a scrubber 128 for removal in order to maintain a clean toxic free discharge into the environment from the apparatus. The majority of the inert gas is recycled from the scrubber 128 or condenser 124 back to the intake fan via recycle line 129.

The discharge spent shale has the lowest toxicity and hydrocarbon content allowing the residual discharge to be used in landfills and in other suitable applications. The pyrolytic extraction of shale oil produces a toxic free discharge essentially free from solvents, such as those that would be present using known solvent extraction processes.

The apparatus 100 includes any of a variety of components for transferring the material through the different levels or zones. For example, the apparatus may incorporate a plurality of vertically displaced material supports such as trays 110. According to one embodiment, the trays may include apertures 132, thereby allowing material to pass through from one tray to a lower tray. For example, the trays 110 may be attached to a rotating structure 130, and thus may rotate about a substantially vertical axis as the structure rotates, with a cantilevered device 134 extending over the trays pushing material through the aperture. Alternatively, the trays may remain stationary, and the cantilevered device may sweep across the trays to transition the material thereon. Accordingly, the material may be transferred from the feed port 112 onto a first tray level, and continuously through the chamber 102 via the tray levels to the residual discharge port 116. For example, the cantilevered devices 132 may be constructed as wiper arms to transfer the material from one tray level to the next tray level below, or gyrating trays with large perforations may be used to shake the material from one tray level down to the next tray. According to the invention shown in FIG. 1, the plurality of spaced apart stacked trays 110 are rotated by the structure 130.

Optionally, as shown in FIG. 1, an external condenser 131 may be located in contact with a circumferential portion of the sidewall 104. The volatized vapors within the chamber 102 will condense on the cold surface of the sidewall 104 cooled by the external condenser 131. The condensate may be collected by an internal circumscribing catch 133 and discharged through an outlet 135. Alternatively, the condensate can be allowed to run down the sidewall 104 where it can be collected and discharged adjacent the bottom plate 108.

Figure 2:
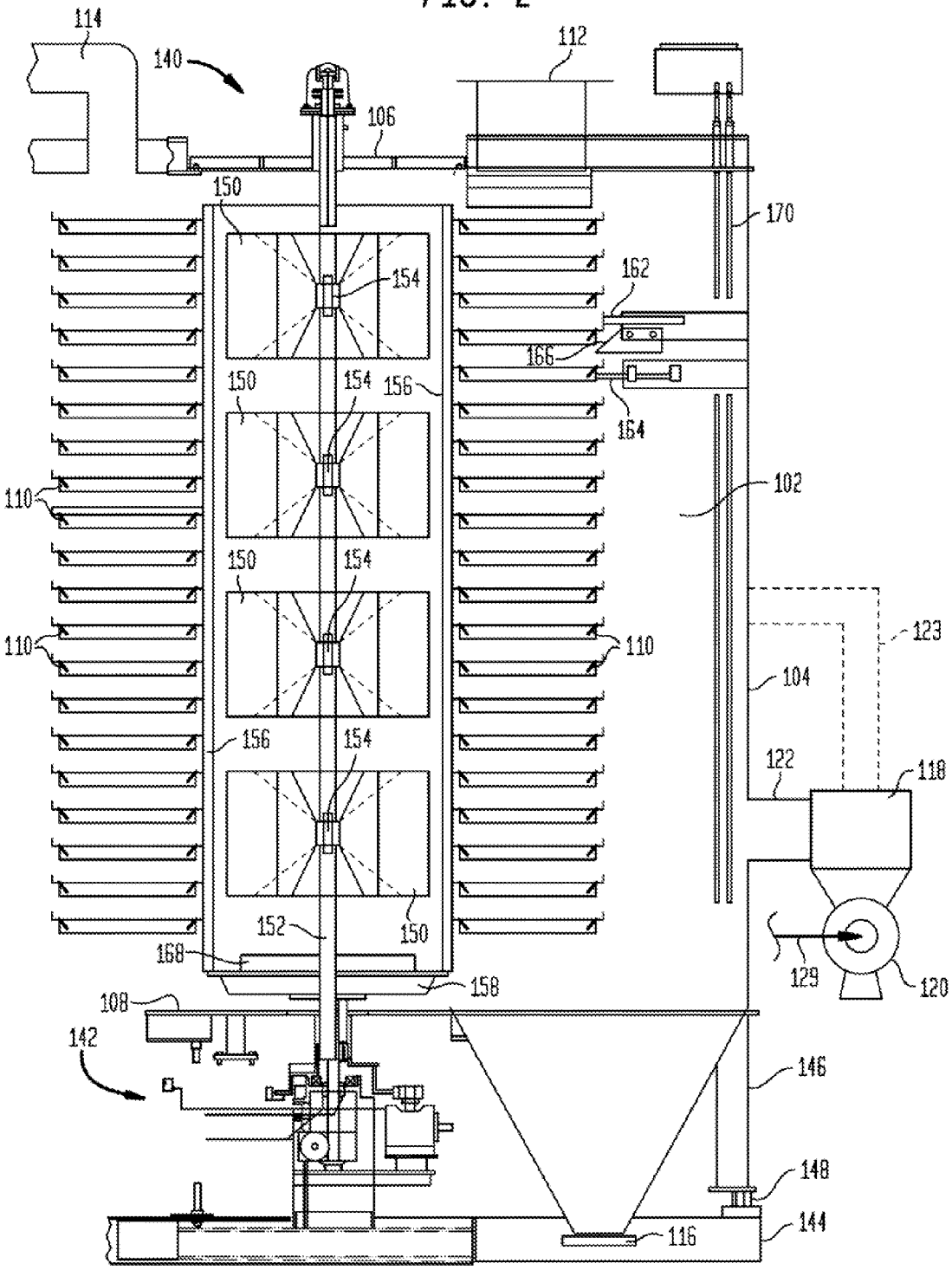
FIG. 2 is a cross-sectional view of another embodiment of such an apparatus in accordance with the present invention.

FIG. 2, where like reference numerals represent like elements, shows an example of an apparatus 140 for processing materials according to another embodiment of the present invention. Certain aspects of the construction of the apparatus described are disclosed and described in co-pending application Ser. No. 11/975,144, filed on Oct. 17, 2007 and in co-pending application Ser. No. 12/456,427, filed on Jun. 15, 2009, the disclosures of which are incorporated herein by reference. The apparatus 140 has particular application for the continuous pyrolytic extraction of hydrocarbons from kerogen containing oil shale fed in the form of particulate material through the apparatus. The apparatus 140 includes a chamber 102, in particular, a series of vertically stacked processing zones wherein the materials are processed. The apparatus 140 further includes at least one drive assembly 142, which may power operations within the chamber 102, though being located outside.

The chamber is enclosed by sidewall 104 which extends around the circumference of the chamber, a top plate 106, and a bottom plate 108. The chamber 102 is supported on a base 144 by supports 146 and may be connected via expansion joints 148. The expansion joints 148 enable the supports 146 to move as the chamber expands due to, for example, increased heat therein. This reduces stress applied to the structure of the apparatus.

Inside the chamber 102, the apparatus incorporates a vertical set of trays 110 surrounding a centrally arranged set of vertically-aligned fans 150 on a rotatable fan shaft 152. The fans 150 may be connected to the fan shaft 152 by keys 154. The fans circulate the heated air or gases inside the chamber over the material in the trays 110 to provide a uniform temperature distribution as may be desired. The material to be processed may be placed on the top tray level and progressively transferred to lower tray levels. Each tray is connected to at least one stanchion 156, wherein several stanchions are positioned around the fan shaft 152, thereby forming a squirrel cage. Coupled to the stanchions 154 is a turntable 158 at the lower end of the chamber. According to one embodiment, the turntable 158 is connected to the trays 110 which are arranged as a rotating tray structure which surrounds the fan shaft 152. Drive gears (not shown) cause the turntable 158 to rotate, thereby causing the stanchions 156 and trays 110 to revolve within the chamber 102.

A tray wiper 162 in the nature of a cantilevered device may be positioned above each tray 110, although not shown for each tray. As each tray rotates, the tray wiper 162 transfers the supported material downwardly to the next tray level. A rigidly mounted leveler 164 may brush across the top of the material placed thereon, thereby leveling the material and exposing materials underneath the top portion to the environment within the chamber. Material that is spilled by the tray wiper 162 over the side of the tray (i.e., between the shaft and the rotating trays) falls onto catch plate 166. This plate 166, angularly positioned with respect to the trays 110, causes the material which is spilled off a tray above to fall into a tray below. In this manner, the material being processed cascades downwardly from the upper tray to the lower tray. According to one aspect, a turntable sweeper 168 may be positioned above the turntable 158. The turntable sweeper may prevent complications potentially caused by material falling onto the turntable 158. As previously described, the trays may be stationary and the tray wiper 162 may be moveable across each tray.

As the processed material is being rotated and moved as described above, further heating elements may be implemented within the chamber 102. Several fans 150 may be included in the chamber to facilitate circulation of heated gasses therein and to effect a more even temperature profile in each zone within the chamber. The fan shaft 152 may connect to a reducer at its lower end which may be powered electrically, or by other sources such as hydraulic, steam, gas, or a mechanical crank. As the reducer causes the shaft 152 to rotate, fan blades 150 would in turn rotate, thus pushing the internal environment within the chamber across the trays 110. The trays 110 and fans 150 are driven by the drive assembly 142.

Alternatively or additionally, internal heating within the chamber may be used. For example, electrical heaters 170 may be placed within the chamber at selected locations to heat the internal gas. In other units, U-tubes (i.e., hollow tubes with flames inside) may be positioned within the chamber and connected to an exhaust and a natural gas inlet port. To prevent the heated gasses within the chamber 102 from escaping, seal assemblies may be placed around the shaft 152 and near the opening in the bottom plate 108.

According to one aspect, the recovery of shale oil from the kerogen feed material may be performed in a TurboDryer® system as may be modified pursuant to the present invention. However, other systems which may be used include any type of a vertical apparatus with trays or plates or hearths that retain the material and in which the material moves down through the apparatus by means of arms, blades, or other such devices.

Figure 3:
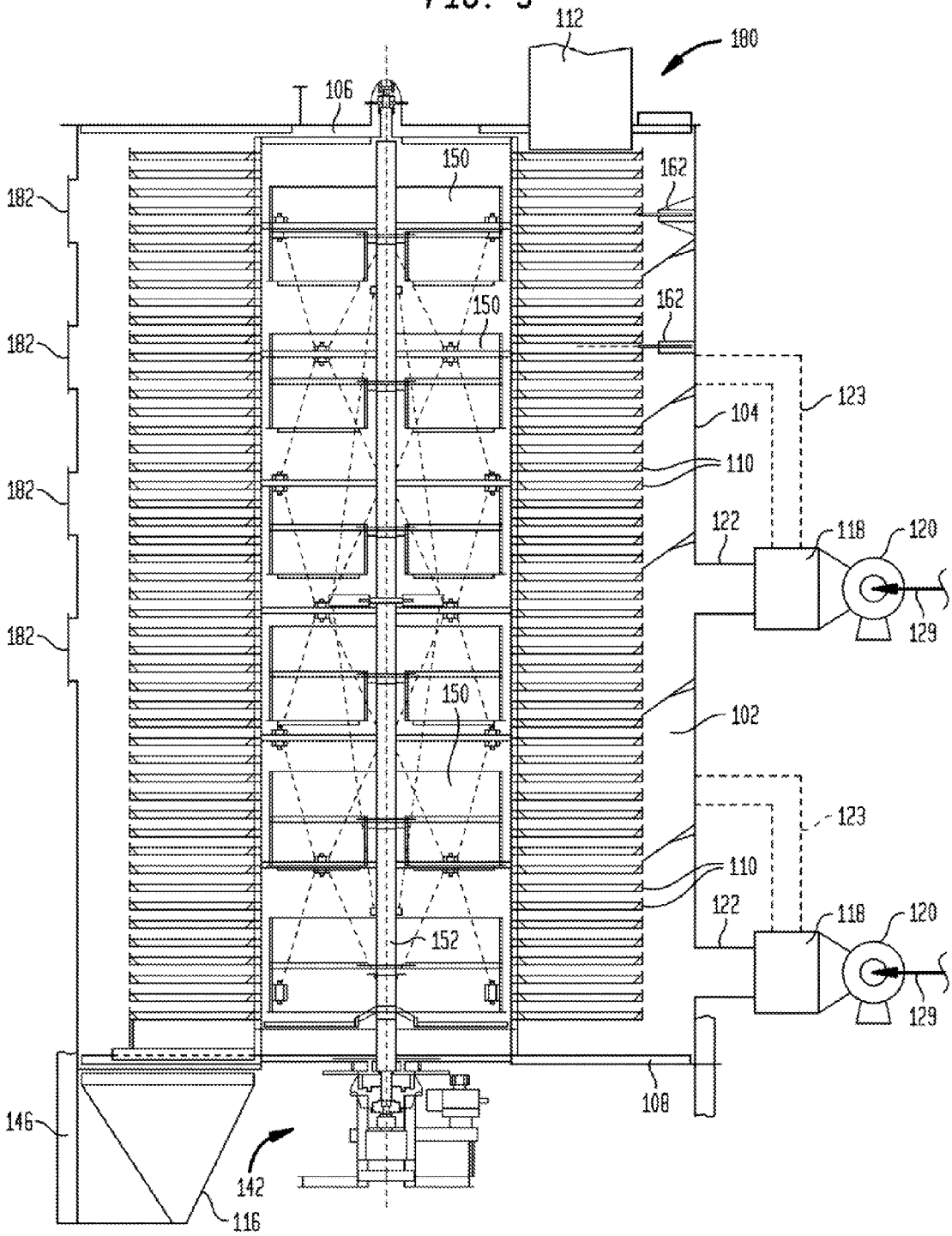
FIG. 3 is a cross-sectional view of another embodiment of such an apparatus having multiple processing zones in accordance with the present invention.

Referring to FIG. 3, where like reference numerals also represent like elements, there is illustrated an apparatus 180 in accordance with another embodiment of the present invention. The apparatus is shown in FIG. 3 where a number of different volatile fractions of gases and/or vapors can be separately recovered from the kerogen in the feed oil shale. The apparatus may include more than one heater 118 located at different levels or zones along the chamber 102, or one heater supplying heated gas to multiple levels of the chamber. In addition, electric heaters may be selectively placed at different levels or zones within the chamber 102. This enables varying the internal temperature within the chamber 102 at different levels. The temperature profile within the chamber can therefore be controlled to facilitate the evaporation of different hydrocarbon fractions from the kerogen at different zones or levels. Hydrocarbons of higher volatility will be driven off at the upper levels or zones of the chamber, while hydrocarbons of lower volatility will be driven off at the lower levels or zones of the chamber. It is also contemplated that multiple fractions of hydrocarbons can be recovered from the chamber 102 operating with a single heat source, or multiple heat sources at the same or different temperature. In this regard, as the feed material is heated within the chamber, the higher volatile components will be volatized and recovered first, followed by the lower volatile components as the material heats to a higher temperature as the material passes downwardly through the chamber 102.

The hydrocarbon fractions will be removed from the chamber 102 at the various levels designated by, for example, a plurality of outlet ports 182. As shown in FIG. 3, recovery of four separate fractions is contemplated, although any number of fractions is possible. Depending upon the composition of the hydrocarbon fractions, the gases can be directed to a condenser 124 or scrubber 128, or other recovery apparatus as may be desired.

A process for extracting hydrocarbons from oil shale as an example will now be described with respect to the apparatus described above, particularly with reference to FIG. 2. Oil shale is initially ground into particulate matter in the form of fine powders to be supplied to the apparatus via feed port 112. The particular matter is ground, for example, to a mesh size in the range of from about 15 to 325 mesh. Smaller mesh size is preferred for the oil shale feed material to facilitate evaporation of the shale oil.

In implementing the process using a rotating tray type apparatus having a plurality of stacked trays 110 with internal circulation fans 150 (such as described above), the oil shale material being processed drops down through the stationary feed port 112 onto the top tray of the rotating trays. Ideally, the material falls onto the trays uniformly. The material may be spread out using, for example, a mounted leveler 164 to give more uniform heating of the material on the trays by exposing materials underneath the top portion to the environment within the chamber. The material on the trays rotates most of the way around the interior of the chamber at each level.

As each tray 110 rotates, the tray wiper 162 transfers the material to the next underlying tray. The material that is spilled by the tray wiper may fall onto the catch plate 166 or other suitable device. The plate 166, angularly positioned with respect to the trays 110, causes the material which is spilled off a tray above to fall onto a tray below. In this manner, the material being processed cascades downwardly from the top trays to the bottom trays. This action is repeated throughout the chamber 102.

As the oil shale continues down through the chamber, the oil shale temperature continues to increase as the material passes into the next chamber processing zone. This process continues through successive zones until the hydrocarbons including the shale oil and other volatiles are volatized. Volatiles are driven off and discharged through vapor outlet 114 to the condenser 124 and/or scrubber 128. During the downward passage of oil shale through the chamber 102 as few as one temperature zone or multiple temperature zones may be encountered depending upon the design of the chamber.

The lighter fractions in the oil shale will be volatized at a temperature of approximately 475° F. It is contemplated that 99% of all volatiles, including the shale oil, will be volatized when the oil shale reaches a temperature of approximately 1000°-1200° F. Therefore, the hot gases for heating the oil shale within the chamber will have a temperature of up to about 1000° F.-1200° F. This will ensure volatilization of substantially all volatiles, thereby producing a residual spent shale being substantially free of volatiles such as organic solvents. It is contemplated that the chamber may be heated for processing the oil shale to a temperature in the range of about 480° F.-1200° F., and move preferably, in the range of about 900° F.-1000° F. However, higher temperatures are also contemplated.

As shown in FIG. 3, an upper and lower processing zone are created by providing separate heaters 118 at spaced apart locations, or a single heater supplying hot inert gas at multiple locations. It is contemplated that the lower heating zone may be at a higher temperature than upper zones within the chamber 102. Accordingly, the higher volatile components such as any organic solvents and/or lighter oil shale components will volatize within the lower temperature upper portion of the chamber, while the lower volatile components such as heavier shale oil will volatize in the higher temperature lower portion of the chamber. As the oil shale cascades through the apparatus, the various volatile fractions will be vaporized as the material heats to increasing hotter temperatures. As the fractions are vaporized, they will be recovered through one of the outlet ports 182. Accordingly, the apparatus 180 is suitable for recovery of separate fractions of hydrocarbons volatized from the kerogen-containing shale oil.

As shown in FIG. 3, an upper and lower processing zone are created by providing separate heaters 118 at spaced apart locations, or a single heater supplying hot inert gas at multiple locations. It is contemplated that the lower heater 118 will be at a higher temperature than the heater positioned more centrally within the chamber 102. Accordingly, the higher volatile components such as any organic solvents and/or lighter shale oil components will volatize within the lower temperature upper portion of the chamber, while the lower volatile components such as shale oil will volatize in the higher temperature lower portion of the chamber. As the oil shale cascades through the apparatus, the various volatile fractions will be vaporized as the material heats to increasing hotter temperatures. As the fractions are vaporized, they will be recovered through one of the outlet ports 182. Accordingly, the apparatus 180 is suitable for recovery of separate fractions of hydrocarbons volatized from the kerogen containing oil shale.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method for extracting hydrocarbons from oil shale containing kerogen, said method comprising:

supplying oil shale in particulate form to a material processing chamber having an upper processing zone for volatizing hydrocarbons of a first volatility and a lower processing zone for volatizing hydrocarbons of a second volatility lower than the first volatility at least including shale oil, said material processing chamber including a plurality of vertically displaced material trays contained within said upper processing zone and said lower processing zone;

passing said oil shale downwardly within said material processing chamber from one material tray to another underlying material tray;

supplying heat at a first temperature to said upper processing zone and at a second temperature to said lower processing zone for volatizing said hydrocarbons from said kerogen, wherein said first temperature is lower than said second temperature;

discharging a first oil shale component volatized within said upper processing zone from said material processing chamber;

discharging a second oil shale component comprising at least shale oil volatized within said lower processing zone from said material processing chamber;

condensing at least the volatized shale oil component; and discharging the residual oil shale from said material processing chamber.

2. The method of claim 1, further including supplying said oil shale in particulate form in the range of about 15 to 325 mesh size.

3. The method of claim 1, wherein the residual of said oil shale discharged from said chamber is substantially free of organic contaminants.

4. The method of claim 1, wherein said lower processing zone is heated to a temperature in the range of 480° F. to 1200° F.

5. The method of claim 1, further including condensing each of the volatized oil shale components.

6. The method of claim 1, wherein said upper processing zone is heated to a temperature in the range of 480° F. to 1200° F.

7. The method of claim 1, wherein said supplying heat comprises supplying heated inert gas.

8. The method of claim 7, further including distributing said heated inert gas within said material processing chamber by at least one or a plurality of fans.

9. The method of claim 1, further including maintaining said material processing chamber at a pressure of about ±0.05-±0.10 inches water.

10. The method of claim 1, further including controlling a temperature profile within the material processing chamber.

11. A method for extracting hydrocarbons from oil shale containing kerogen, said method comprising:

supplying oil shale in particulate form to a material processing chamber having an upper processing zone for volatizing hydrocarbons of a first volatility and a lower processing zone for volatizing hydrocarbons of a second volatility lower than the first volatility at least including shale oil, said material processing chamber including a plurality of vertically displaced material trays contained within said upper processing zone and said lower processing zone;

passing said oil shale downwardly within said material processing chamber from one material tray to another underlying material tray;

supplying heat at a first temperature to said upper processing zone and at a second temperature to said lower processing zone for volatizing said hydrocarbons from said kerogen, wherein said first temperature is lower than said second temperature;

discharging a first oil shale component volatized within said upper processing zone from said material processing chamber through a first outlet port;

discharging a second oil shale component comprising at least shale oil volatized within said lower processing zone from said material processing chamber through a second outlet port;

condensing at least the volatized shale oil component; and discharging the residual oil shale from said material processing chamber.

12. The method of claim 11, further including controlling a temperature profile within the material processing chamber.

* * * * *